US006817443B1

(12) United States Patent
Metz

(10) Patent No.: US 6,817,443 B1
(45) Date of Patent: Nov. 16, 2004

(54) HIGH RISE EMERGENCY ESCAPE APPARATUS

(76) Inventor: Michael Wayne Metz, 115 S. Good Hope Rd., Greenville, PA (US) 16125

( * ) Notice: Subject to any disclaimer, the term of this patent is extended or adjusted under 35 U.S.C. 154(b) by 0 days.

(21) Appl. No.: 10/299,727

(22) Filed: Nov. 19, 2002

(51) Int. Cl.[7] ..... A62B 1/20
(52) U.S. Cl. ..... 182/82; 182/3; 182/36
(58) Field of Search ..... 182/82, 36, 37, 182/3, 4, 71, 72

(56) References Cited

U.S. PATENT DOCUMENTS

| | | | | |
|---|---|---|---|---|
| 489,463 A | | 1/1893 | Coker | |
| 786,641 A | | 4/1905 | Grossmann | |
| 3,498,408 A | * | 3/1970 | Foote | 182/6 |
| 4,121,689 A | | 10/1978 | Bonvin | |
| 4,125,172 A | | 11/1978 | Hatala | |
| 4,295,543 A | | 10/1981 | Graham | |
| 4,350,224 A | | 9/1982 | Jochum et al. | |
| 4,406,349 A | * | 9/1983 | Vilchek | 182/7 |
| 4,499,966 A | | 2/1985 | Milne et al. | |
| 4,520,895 A | * | 6/1985 | Armstrong | 182/3 |
| 4,629,032 A | | 12/1986 | Armstrong | |
| 4,709,782 A | | 12/1987 | Lipinski | |
| 5,056,619 A | | 10/1991 | Darnell et al. | |
| 5,115,885 A | | 5/1992 | Chouest | |

* cited by examiner

*Primary Examiner*—Alvin Chin-Shue
(74) *Attorney, Agent, or Firm*—Michael I. Kroll

(57) ABSTRACT

The present invention 10 discloses an emergency descent system for a tall building 12. The high rise emergency descent system is comprised of at least one track 18 fixedly attached to the exterior of a building 12 and a jumpsuit 20 having an integral harness 22 and descent device 23 connected to the suit by means of a cable 36 that will allow the user 12 to don the apparel having a first preselected drag brake 52 designed for a weight class that is reflected in the size of suit, and, to attach the descent device 23 to the descent track18 and descend to the ground at a controlled rate. A second brake control 26 is provided for allowing the user 16 more individual brake control during the descent down the building 12.

11 Claims, 10 Drawing Sheets

HIGH RISE EMERGENCY ESCAPE APPARATUS

BACKGROUND OF THE INVENTION

1. Field of the Invention

The present invention relates generally to escape systems and, more specifically, to a high rise emergency descent system. The high rise emergency descent system is comprised of at least one track fixedly attached a tall building and a device for attachment thereto whereby a person can put on a jumpsuit having an integral harness and descent assembly that will allow the user to attach to the descent track and descend to the ground.

The system is based on providing a descent device that considers the variations of individual weight of the users. Each descent device has a drag brake that controls the rate of descent of the user. The drag brake is comprised of a brake pad under pressure engaging the descent track as the user descends to the ground.

To insure the correct mating between a descent device and a user the descent device is permanently attached to a jumpsuit or other compatible apparel that is donned by the user having an integral harness and descent device attached thereto. The size of the jumpsuit correlates directly to the duty rating of the pressured descent device. Therefore a smaller suit incorporates a lesser pressured brake than a larger suit having a greater pressured brake. Therefore, the descent rate can be equalized for a mixture of individuals by providing a plurality of jumpsuits having a pressured drag brake for that size of individual.

At the point of departure a plurality of various sized descent apparel can be stored and as individuals arrive they would select the appropriately sized garment, don the garment, move to the point of departure, and attach the descent device to the track and under a controlled descent move to the ground.

The descent device also incorporates an additional braking mechanism comprised of a hydraulic piston that moves a brake pad into an engaging position with the descent track. The hydraulic piston has control means attached to the descent device that is user controlled. Therefore, users can effect the rate of descent by engaging the control mechanism for the hydraulic brake.

The descent device is a substantially C-shaped device having opposing channels on the backside that hold and guide the descent device along the descent track. Extending transversely from the descent device are handle grips providing means for a user to hold and steady themselves while traveling along the descent track. The handle grips can incorporate a control mechanism for the hydraulic brake providing means whereby the user can control their rate of descent along the descent track. The brake mechanism has connection means for controlling the application of the brake pads to the descent track using a hydraulic cylinder mounted on the descent device and in fluid connection with a brake pad.

2. Description of the Prior Art

There are other fire escape devices designed for evacuating a building. Typical of these is U.S. Pat. No. 489,463 issued to Coker on Jan. 10, 1893.

Another patent was issued to Grossmann on Apr. 4, 1905 as U.S. Pat. No. 786,641. Yet another U.S. Pat. No. 4,121,689 was issued to Bonvin on Oct. 24, 1978 and still yet another was issued on Nov. 14, 1978 to Hatala as U.S. Pat. No. 4,125,172.

Another patent was issued to Graham on Oct. 20, 1981 as U.S. Pat. No. 4,295,543. Yet another U.S. Pat. No. 4,350,224 was issued to Jochum et al on Sep. 21, 1982. Another was issued to Vilchek on Sep. 27, 1983 as U.S. Pat. No. 4,406,349 and still yet another was issued on Feb. 19, 1985 to Milne et al as U.S. Pat. No. 4,499,966.

Another patent was issued to Armstrong on Dec. 16, 1986 as U.S. Pat. No. 4,629,032. Yet another U.S. Pat. No. 4,709,782 was issued to Lipinski on Dec. 1, 1987. Another was issued to Darnell et al on Oct. 15, 1991 as U.S. Pat. No. 5,056,619 and still yet another was issued on May 26, 1992 to Chouest as U.S. Pat. No. 5,115,885.

A portable fire escape comprising a suitable frame, means for suspending a person therefrom, a circumferentially recessed brake wheel or drum journaled in said frame, a cable having one end secured to said brake wheel and adapted to be wound thereon with in said recess, and a flexible band partially encircling the brake-wheel and extending across the recess; said band having one end fixed and the other end secured to an operating lever for tightening the band, substantially as described.

The combination, with the vertical wall of a building structure, of a lift, grooved guides for the lift set into said wall, and lift-ropes connected with the lift and arranged in said guides, substantially as described.

An escape mechanism for enabling a person to escape at any floor of a building, the escape mechanism including a vertically disposed hollow rail and at least one rack disposed within the rail. At least one running and suspension apparatus is adapted to be introduced within the rail, where the apparatus is equipped with support members and includes an engagement portion having at least one pinion. The pinion engages the rack to allow the apparatus to move along the rail only upon rotation of the pinion. The engagement portion includes impeding assemblies having inertial escapement members for hindering the rotation and for slowing the descent of the apparatus by gravity while the engagement portion is engaged within the rail.

A riding emergency or fire escape apparatus mountable interior of a building for delivering an inhabitant exterior of the building for free fall descent to the ground. The apparatus of this invention exterior of the building essentially comprises plate members mounted in a recess provided in the wall of the building or spaced from the wall of the building a few inches so as not to detract from the architecture of the building. A base plate is provided with a vertically extending zigzag track. A cover plate overlaying and planularly spaced from the base plate is formed with a vertically extending lineal track. The passenger transport mechanism is provided with a chair and is mountable interior of the building. Similarly arranged base and cover plates containing zigzag tracks and lineal tracks respectively, are provided at each floor level interior of the building. The tracks of the respective plates align with the corresponding tracks in the fire escape structure exterior of the building through an openable door at each floor level. The passenger transport mechanisms stored at each floor level, comprise a chair connected to a vertically disposed roller trolley frame which is provided with rollers which ride the zigzag track for a slowed down free fall descent while a second roller rides in the vertical track so that the passenger chair is restrained to a lineal vertical descent.

A fire escape apparatus comprises a vertically extending channel member defining a channel into which opens a slot formed between flanges constituting a front wall of the channel member. Rows of staggered projections within the channel are formed by bolts extending between the flanges and a rear wall of the channel member. A harness for supporting a person escaping in the event of fire or other emergency is suspended from a T-shaped support including a cross-piece, and an upright. In use, the cross-piece and upright are introduced into the channel through the slot. A lug on the upright projects through the slot and limits side-side movement as the harness support descends under the weight of the person escaping, the cross-piece co-operating with the bolts to perform a stepping movement.

A rescue for a multi-floor building includes an upright climb rail assembled of profiled rail sections defining two lateral cooling channels and an upright tooth rack extending around the entire length of the rail; a rescue cabin includes a projecting frame insertable into a front guiding slot in the rail and supporting a driving gear engaging the upright tooth rack; the frame of the cabin overlaps safety windows provided on each floor of the building and has an entrance opening facing the windows.

An emergency escape apparatus includes a gear track mounted vertically on an exterior surface of a building. A carriage is provided with guide rollers which engage a guide track oriented adjacent and parallel to the gear track. A gear wheel is rotatably mounted on the carriage and is maintained in positive engagement with the gear track by the guide rollers. The carriage includes automatic brakes which serve to limit the maximum downward velocity of the carriage, and a boatswain's chair is attached to the carriage to secure one or more persons to the carriage for transport down the outside of the building.

A gravity operated emergency system for a multi-story building is disclosed including an elongate track having a central rack which is disposed along an outside wall of the building. A traveler is provided which moves along the track and has a pinion which rotatably engages the rack. A pair of bearing members engage opposite sides of the track and these bearing members are pivotally attached to the traveler so that as the pinion is brought into contact with the rack the bearing members clear the respective sides of the track and when the pinion is fully engaged in the rack the bearing members are resiliently urged into contact with an inside face of the track. A velocity control mechanism is provided to control the rotational speed of the pinion in the rack, and hence the speed of the traveler relative to the track. During an emergency, the user is received in a harness which is connected to the traveler and the traveler slowly lowers the user to safety along the track.

The present invention contemplates a descent device including a roller having an annular groove about its contact surface, a support structure to which the roller is rotatably attached, a pinion gear rotatably attached to the support structure, a rotor disk directly coupled to the pinion gear, a braking device coupled to the support structure for controlling the speed of rotation of the rotor, a hand held actuator for activating the brake device, and a sling attached to the support structure capable of supporting a person who can control his or her descent by actuating the brake device, enabling a person to escape from a building during emergency conditions. The present invention also contemplates the combination of the above-described descent device and a vertically extending rail-like support track which is fixedly secured to the exterior of a building wall. The track is shaped substantially like an I-beam in which one edge of the I-beam includes a plurality of recesses and projections to form a rack designed to correspond with the pinion gear of the descent device, while the other edge of the I-beam is straight and smooth and is designed to correspond with the roller whose contact surface contacts the smooth edge.

A high-rise fire escape device gravity operated and particularly adaptable for use in high-rise building and modern skyscraper structures as an escape apparatus from any floor of a building for use in the rescue of an occupant who may be trapped and prevented from using the conventional stairways or elevator due to a natural or man-made disaster such as fire, electrical or power failure, building collapse or personal injury of the occupants, etc. The apparatus or device comprises the combination of a vertical skid track member attached to the wall of a building with a skid which is inserted into a guide channel located in the track. The skid track is designed to be attached to either a new or existing building with access to the skid track being available at the outside of the building at predetermined locations, such as, building corners or a plurality of locations intermediate to the corners between the building windows so as not to impede the architecture design of the building. The skid track has a back and guide portion with a plurality of spring loaded or hinged skid track doors which allows the insertion of a skid to which the occupant of a building may be attached. The skid is so designed to allow its movement down the vertical skid track with the occupant attached, with its rate of descent being controlled by a plurality of descent retarders suitably disposed along the skid tracks entire length. The descent retarder is disposed within the back section of the skid track and partially protrudes into the guide channel of said track. As the skid moves down the guide channel of the skid track it comes into fractional contact with the biased plane frictional surface of the plurality of protruding descent retarders disposed along its vertical axis causing the descent retarder to be displaced in horizontal direction perpendicular to direction of the skid movement. The movement of the descent retarders in a horizontal direction is resisted by means just as a plurality of springs interposed between the rear of the descent retarders and the inside the back portion of the skid track. While the majority of the descent retarders are spaced uniformly along the entire length of the vertical skid track, there are some that are placed in a closer or cluster configuration near the end of the vertical skid track to more greatly impede the rate of descent or velocity of the occupant user so as to prevent forceful contact with the ground. During an emergency, a building occupant may put on a harness of any standard construction and attach it to the skid which can easily be inserted into the guide portion of the vertical skid track through any of the plurality of track doors disposed along said skid track.

A controlled descent device is disclosed, including an elongate guide assembly that has an upper portion, a lower portion and a generally helical track that extends from the upper portion to the lower portion. A carriage includes a primary bearing that is engaged with and movable within the track. A harness is secured to the carriage and the carriage is descendible along the track to lower a person fastened in the harness from the upper portion of the guide assembly to the lower portion thereof.

A fire escape device incorporated into new buildings or added on to existing buildings by which occupants of the building may quickly and safely exit from the building in the case of fire or other emergency conditions. The fire escape device includes a vertical track or guide that slidably receives a slide in the form of a backpack attached to each person using the fire escape device. The slide or backpack includes an oscillatable control member that swings back and forth about an axis perpendicular to the track or guide and engages a plurality of stationary pins oriented in staggered spaced relation on opposite side of the guide or track and control members that control the speed of descent of the slide or backpack and the individual supported thereon. An interlock device is provided to control access to the track or guide to insure proper sequential use of this fire escape device by a plurality of individuals. The lower end of the fire escape device includes an angulated discharge chute or ramp or transversely aligned control pins to stop the slide or backpack just prior to reaching a bottom support surface to enable a person to safely use the fire escape device. The arrangement of the components also will stop succeeding users until the lower most user has exited from the fire escape device.

While these escape systems may be suitable for the purposes for which they were designed, they would not be as suitable for the purposes of the present invention, as hereinafter described.

SUMMARY OF THE PRESENT INVENTION

The present invention is a high rise emergency descent system. The high rise emergency descent system is comprised of at least one track fixedly attached to the exterior of a building and a jumpsuit having an integral harness and descent device connected to the suit by means of a tether that will allow the user to don the apparel having a first preselected drag brake designed for a weight class that is reflected in the size of suit, and, to attach the descent device to the descent track and descend to the ground at a controlled rate. A second brake control is provided for allowing the user more individual brake control during the descent down the building.

A primary object of the present invention is to provide an emergency system whereby occupants of high rise building can be quickly evacuated.

Another object of the present invention is to provide an emergency system having one or more descent tracks fixedly attached to a building.

Yet another object of the present invention is to provide an emergency escape system for tall buildings having at least one descent track and a point where users can attach to said track for exiting said building.

Still yet another object of the present invention is to provide an emergency escape system for tall buildings having an apparel device that can be used by individuals to exit the building.

Another object of the present invention is to provide an emergency escape device having a plurality of available garment of various sizes.

Yet another object of the present invention is to provide an emergency escape device having a plurality of available garment of various sizes having a harness with a descent device attached thereto by means of a tether.

Still yet another object of the present invention is to provide a descent device comprised of a substantially C-shaped module that can be attached to the descent track.

Another object of the present invention is to provide descent device incorporating a drag brake comprised of a pressured brake pad.

Yet another object of the present invention is to provide a pressured brake pad wherein said pressure correlates to the size of the descent apparel which directly relates to the weight of the user.

Still yet another object of the present invention is to provide a descent device having a hydraulic piston engaging a brake pad that can be used to control the rate of descent of the device.

Another object of the present invention is to provide a descent device having control means for engaging the hydraulic brake of the descent device.

Yet another object of the present invention is to provide user access to the hydraulic brake pad control means whereby the user can selectively engage the control means to effect the rate of descent of the descent device.

Additional objects of the present invention will appear as the description proceeds.

The present invention overcomes the shortcomings of the prior art by providing a high rise emergency descent system comprised of at least one track fixedly attached a building and a device for attachment thereto whereby a user can descent to the ground under controlled conditions. The descent device considers the variations of individual weight of the users. Each descent device has a drag brake comprised of a brake pad under pressure that continuously engages the descent track as the user descends to the ground.

To insure the correct mating between a descent device and a user the descent device is permanently attached to a jumpsuit or other appropriate apparel having an integral harness and descent device attached thereto that is donned by the user. The size of the jumpsuit correlates directly to the duty rating of the pressured descent device. Therefore a smaller suit incorporates a lesser pressured brake than a larger suit having a greater pressured brake. Therefore, the descent rate can be equalized for a mixture of individuals by providing a plurality of jumpsuits having a pressured drag brake for that size of individual. The descent device also incorporates an additional braking mechanism that is under user control comprised of a hydraulic piston that moves a brake pad into an engaging position with the descent track thereby users can effect the rate of descent by engaging the control mechanism for the hydraulic brake.

The foregoing and other objects and advantages will appear from the description to follow. In the description reference is made to the accompanying drawings, which form a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWINGS

In order that the invention may be more fully understood, it will now be described, by way of example, with reference to the accompanying drawings in which.

LIST OF REFERENCE NUMERALS

Figure 1:
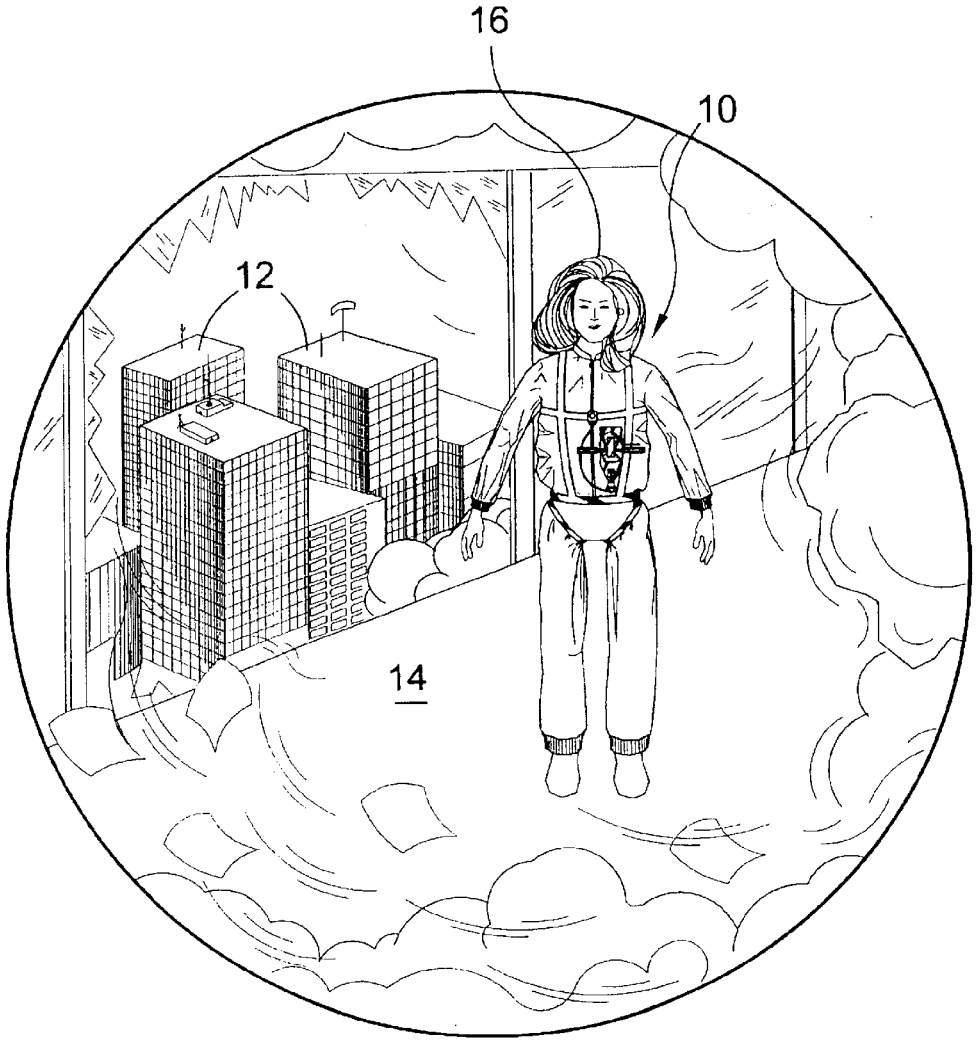
FIG. 1 is an illustrative view of the present invention in use.

With regard to reference numerals used, the following numbering is used throughout the drawings.

10 present invention
12 tall building
14 departure point
16 user
18 descent track
20 descent suit
22 harness
23 descent assembly
24 descent assembly housing
26 brake control
28 handle
30 master cylinder
32 upper piston
34 lower piston
36 harness cable
38 large suit
40 medium suit
42 small suit
44 frictionous material
46 attachment member
48 flange
50 brake pad for upper piston
51 brake pad for lower piston
52 coiled spring
54 outer face of descent track
56 brake release lever
58 brake release tab
60 semi-interior cavity
62 inner surface of top side of descent assembly housing
64 inner surface of flange
66 cylindrical housing
68 cylindrical housing
70 pivotable connection

DETAILED DESCRIPTION OF THE PREFERRED EMBODIMENT

The following discussion describes in detail one embodiment of the invention. This discussion should not be construed, however, as limiting the invention to those particular embodiments since practitioners skilled in the art will recognize numerous other embodiments as well. For a definition of the complete scope of the invention, the reader is directed to the appended claims.

Turning to FIG. 1, shown therein is an illustrative view of the present invention 10 in use. The present invention 10, a personal descent jump suit, is designed for emergency evacuation from skyscrapers or tall buildings 12. The suit is issued to the employee or a variety of sizes are stored at the evacuation point 14 of departure where an individual 16 will select the appropriate size and after donning their suit they will attach their descent device to the descent track which will safely guide them to the ground. The suits are made in various sizes because the descent device has a preselected drag brake mechanism for controlling their rate of descent. The descent device also has a hydraulic brake that is under the user's 16 control to provide selective descent control in addition to the preselected suit designed brake mechanism.

Figure 2:
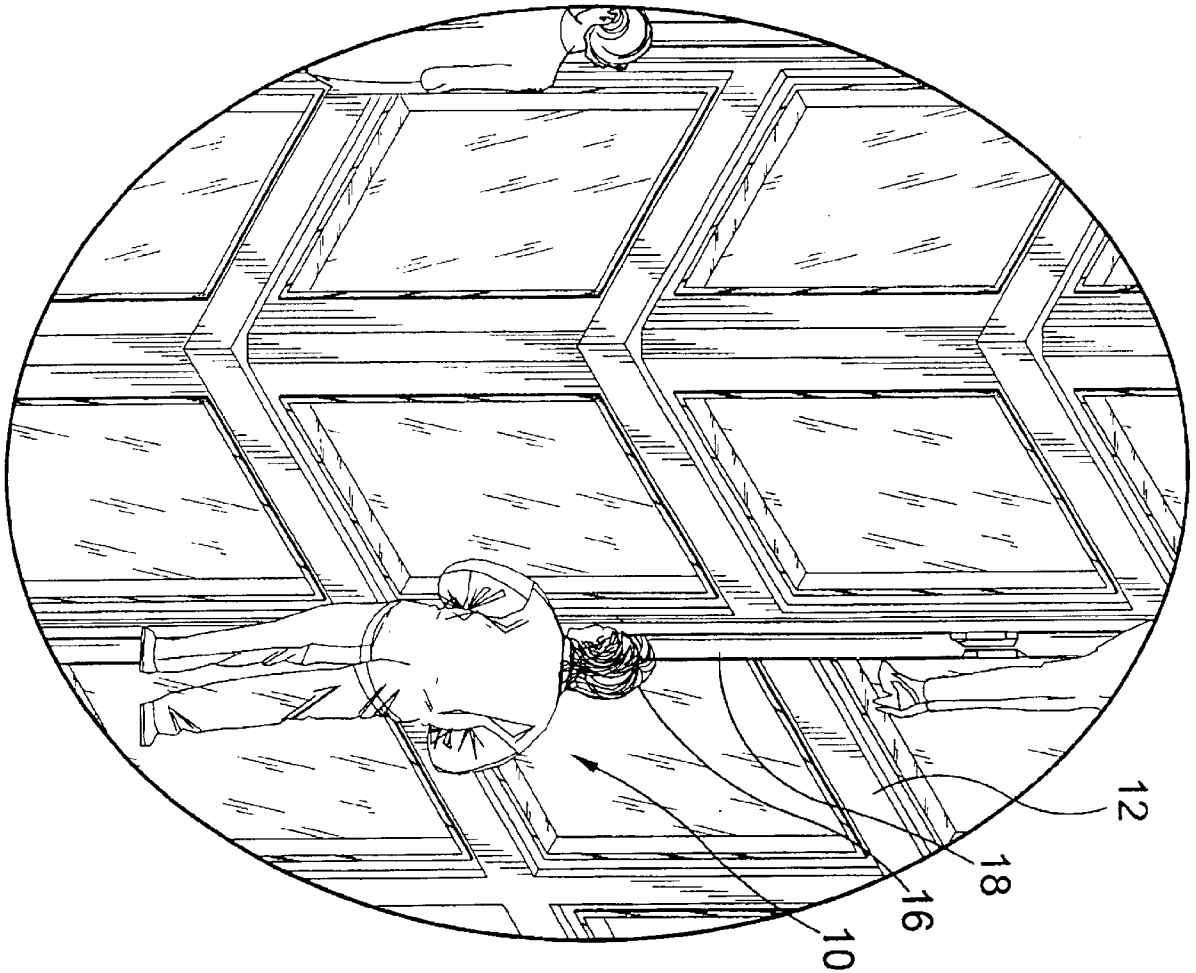
FIG. 2 is and illustrative view of the present invention in use.

Turning to FIG. 2, shown therein is an illustrative view of the present invention 10 in use. Shown is the present invention 10 being used by a user 16 in an emergency evacuation from a sky scraper or tall building 12 having a plurality of longitudinally extending I-beam shaped descent tracks 18 attached to the exterior thereof extending from top to bottom and being fabricated in a manner that allows for the attachment thereon of a personal descent assembly having a preselected first brake designed for the descent suit size and a second user controlled hydraulic brake control so that the user 16 may attach themselves to the descent track and descend to the ground by means of the first brake and user controlled second hydraulic brake to control their rate of descent down the side of the building 12.

Figure 3:
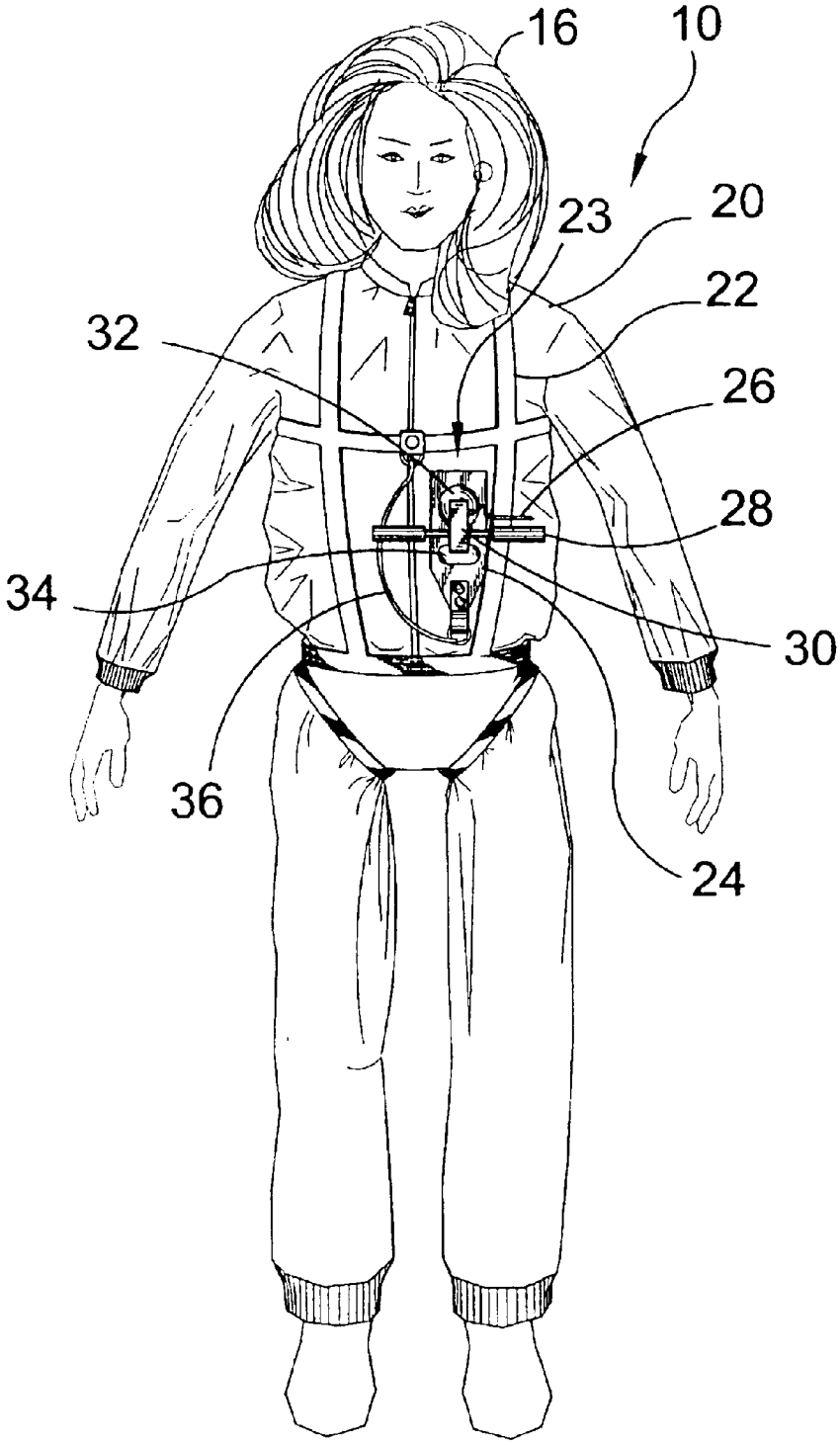
FIG. 3 is and illustrative view of the present invention.

Turning to FIG. 3, shown therein is an illustrative view of the present invention 10. Shown is the descent suit 20 of the present invention 10 being worn by a user 16 having a harness 22 forming an integral part of the suit 20 and descent assembly housing 24. The suits 20 are made in various sizes that reflects a duty rating for the preselected drag brake control of the descent assembly 23 have a housing 24 that basically determines the descent rate of the suit wearer 16 during a descent session. The suits 20 can also be made to accommodate special needs such as the physically challenged and can be manufactured in various colors to indicate such. The descent device 23 also incorporates a second hydraulic brake that is under control of the user allowing the user 16 to stop or slow down as determined by the user. Also shown are the brake control 26, handle 28, master cylinder 30, upper hydraulic piston 32, lower preselected piston 34 and harness cable 36.

Figure 4:
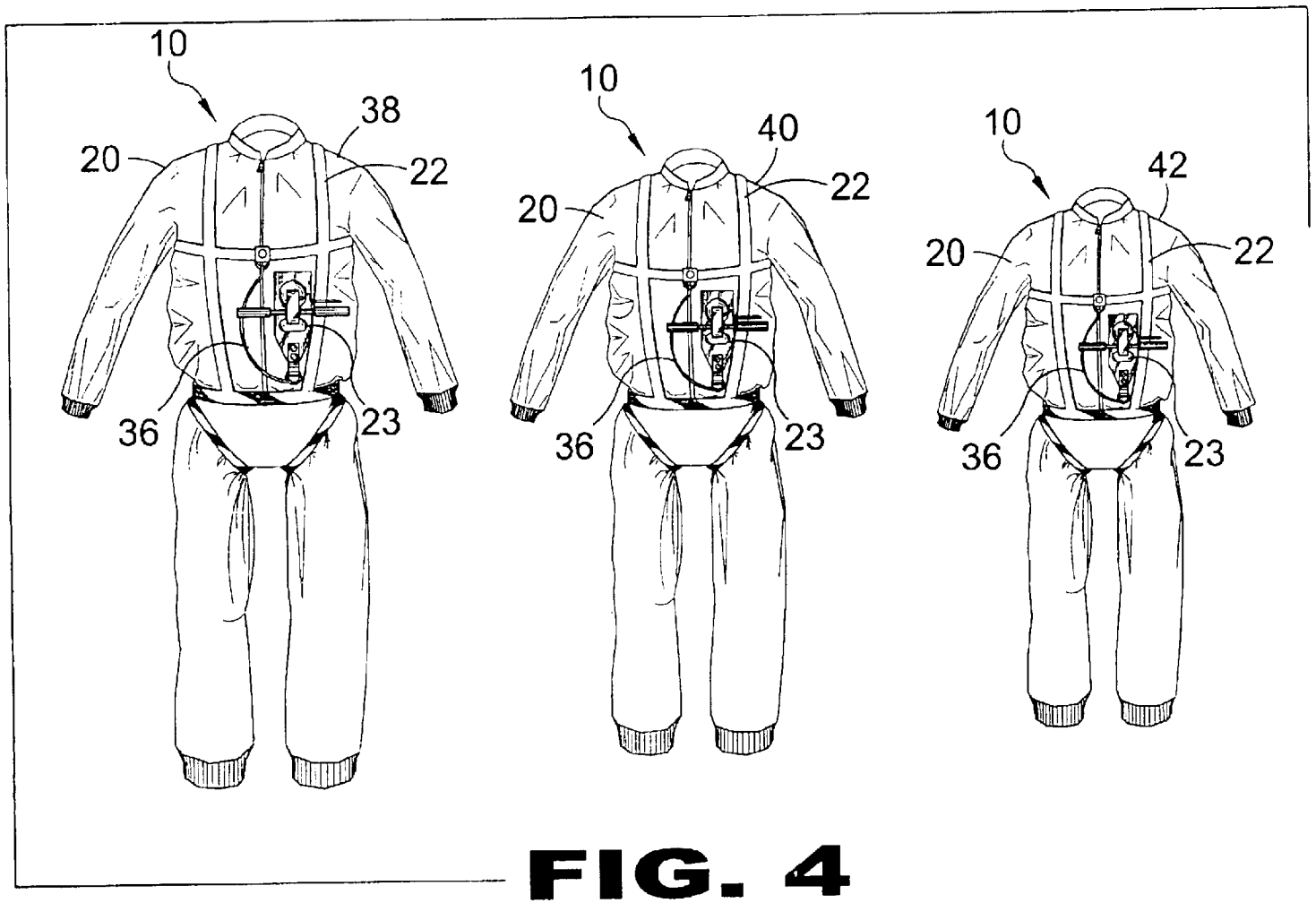
FIG. 4 is an illustrative view of the present invention.

Turning to FIG. 4, shown therein is an illustrative view of the present invention 10. Shown is one possible variation in suit 20 sizes being large 38, medium 40 and small 42. Each suit has an integral harness 22 and descent device 23 that is attached to the suit harness by a cable 36. Each descent device 23 has two braking mechanisms. One brake mechanism is a preselected tension loaded brake that is tensioned according to the suit 20 size. Larger Suits 38 have a greater braking pressure than medium 40 or smaller 42 suits thereby controlling the descent rate. The second braking mechanism is a hydraulic brake having control means accessible to the user whereby the user can apply the hydraulic brake as the user deems necessary.

Figure 5:
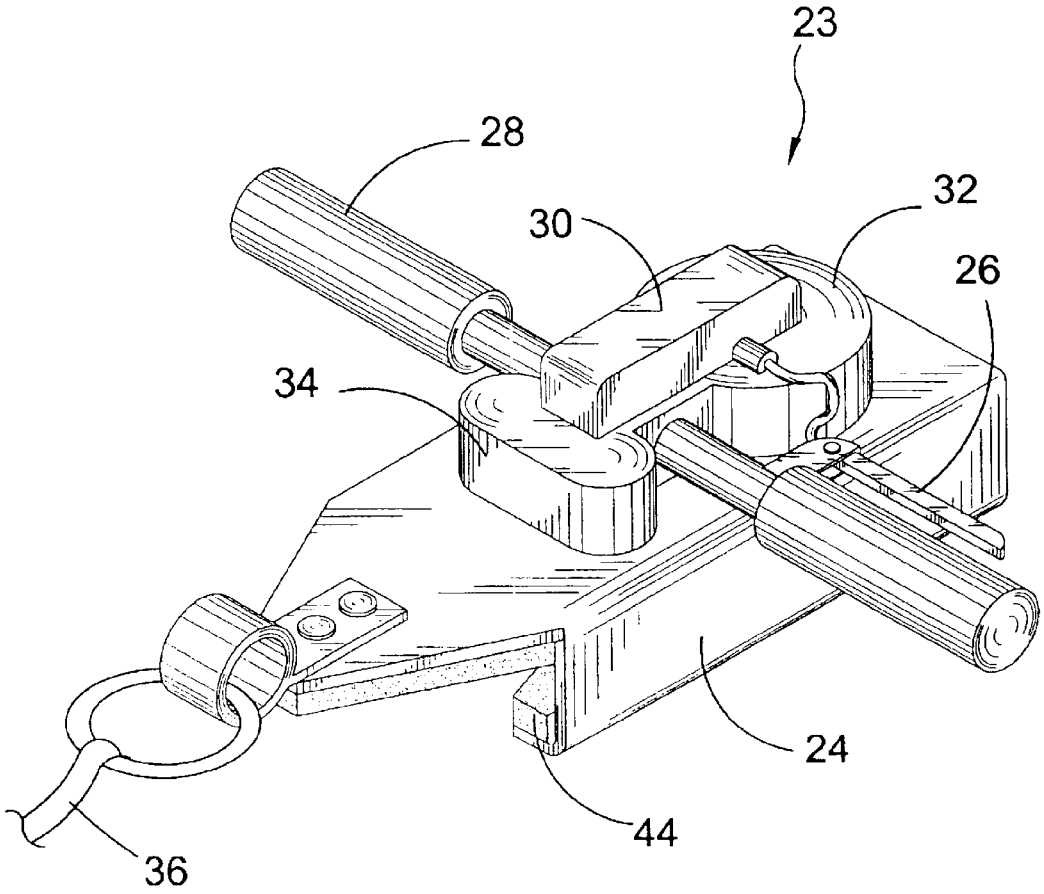
FIG. 5 is a perspective view of the descent device.

Turning to FIG. 5, shown therein is a perspective view of the descent device assembly 23. Shown is the descent assembly 23 of the descent suit of the present invention having a preselected brake associated with a lower tension piston 34 wherein the pressure is calculated to apply a predetermined braking force determined by the weight of the individual as related to suit size. To insure the correct mating of a descent device 23 to the weight of the individual, the descent device 23 is fixedly mounted to a suit that is sized for the duty weight of the descent device 23. In addition to the preselected tension brake a second hydraulic brake associated with upper piston 32 is provided whereby the user can selectively apply the hydraulic brake as needed. Also shown are the hydraulic brake control 26, handle 28, master cylinder 30, housing 24, frictionous material 44 and harness cable 36.

Figure 6:
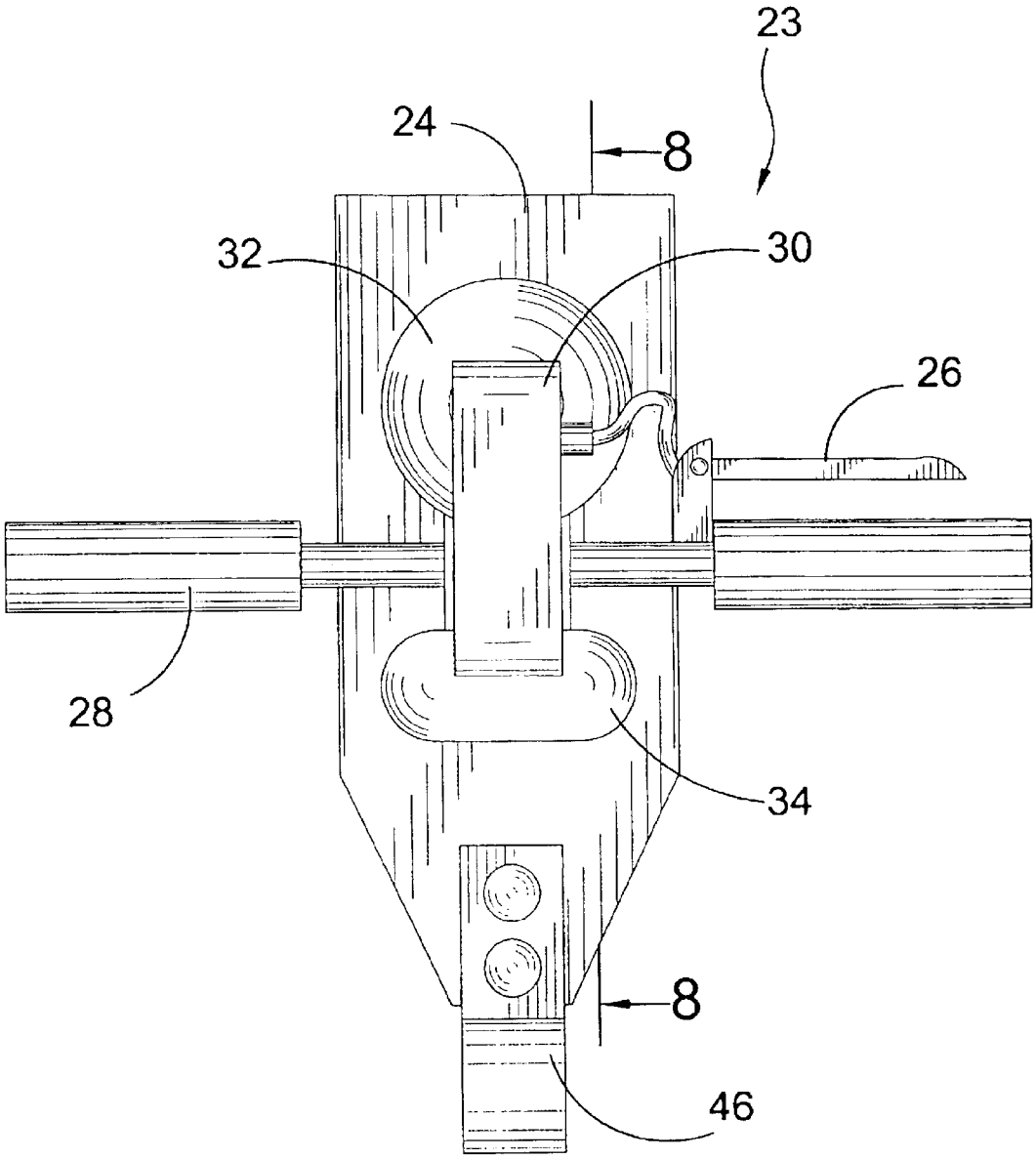
FIG. 6 is a top view of the descent device.

Turning to FIG. 6, shown therein is a top view of the descent assembly device 23. Shown are the descent assembly 23 and descent assembly housing 24 of the present invention having two handles 28 for hand placement of the user during descent to allow for control of the user's body and easy manipulation of the brake control 26. The brake control 26 is attached to a master cylinder 30 that when activated produces pressure in the upper piston 32 to displace the inner piston into a position that allows the brake pad to engage the descent track to slow the user's descent as they travel down the descent track. The lower tension piston 34 is associated with the preselected brake. The tension of the lower piston 34 coincides with the size of the jump suit that it is attached to. The bigger the jumpsuit harness the greater the pressure on the drag brake of the lower piston 34. An attachment member 46 is fixedly attached to housing 24 and is for receiving the harness cable.

Figure 7:
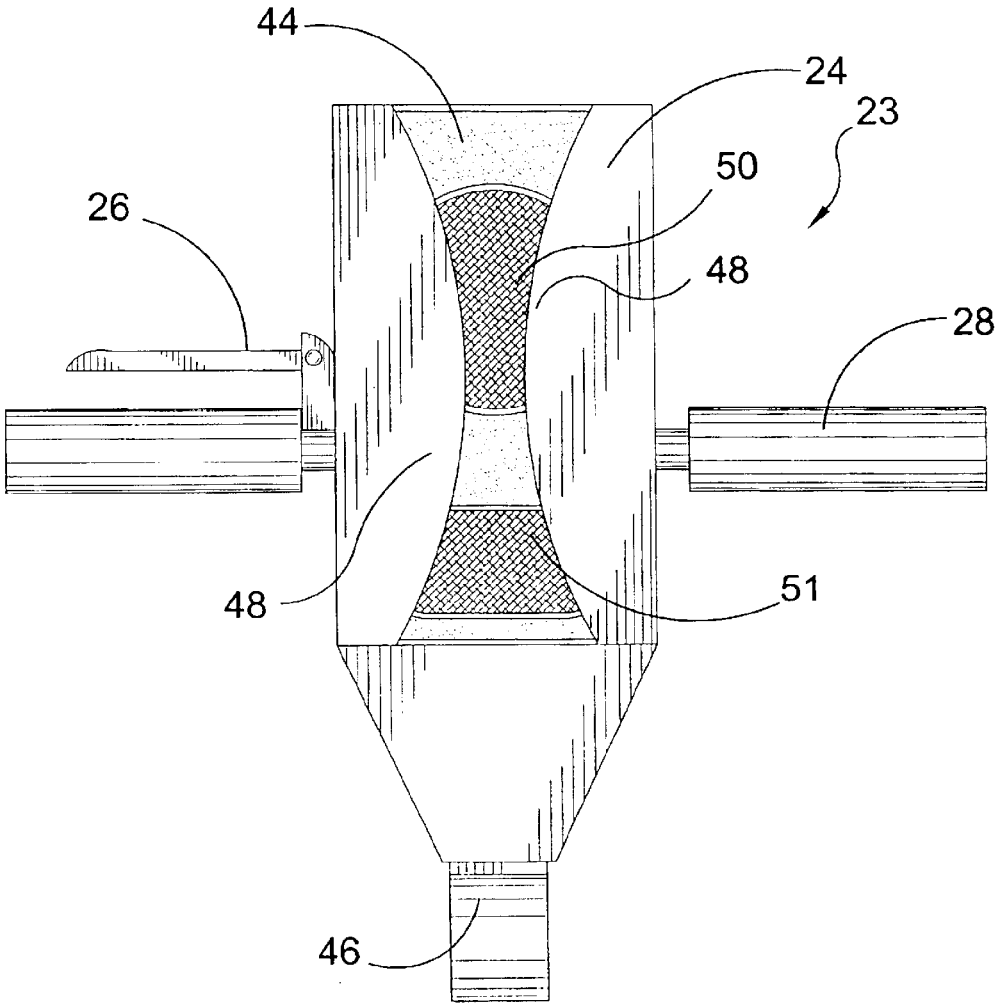
FIG. 7 is a bottom view of the present invention.

Turning to FIG. 7, shown therein is a bottom view of the present invention 10. Shown are the bottom of the descent assembly 23 and its housing 24 having a structure whereby two opposing channels are formed by curved flanges 48 extending inwardly on the bottom side portions of the descent assembly 23. Also shown is the opposed channels having a frictionous material 44 lining that produces a reduced free fall speed of the descent assembly. Additionally shown are a plurality of brake pads 50, 51 that work in correlation with the upper and lower pistons respectively, to produce larger frictional coefficients on the descent track to further slow the user's descent as desired. Also shown are handle 28, brake control 26 and attachment member 46.

Figure 8:
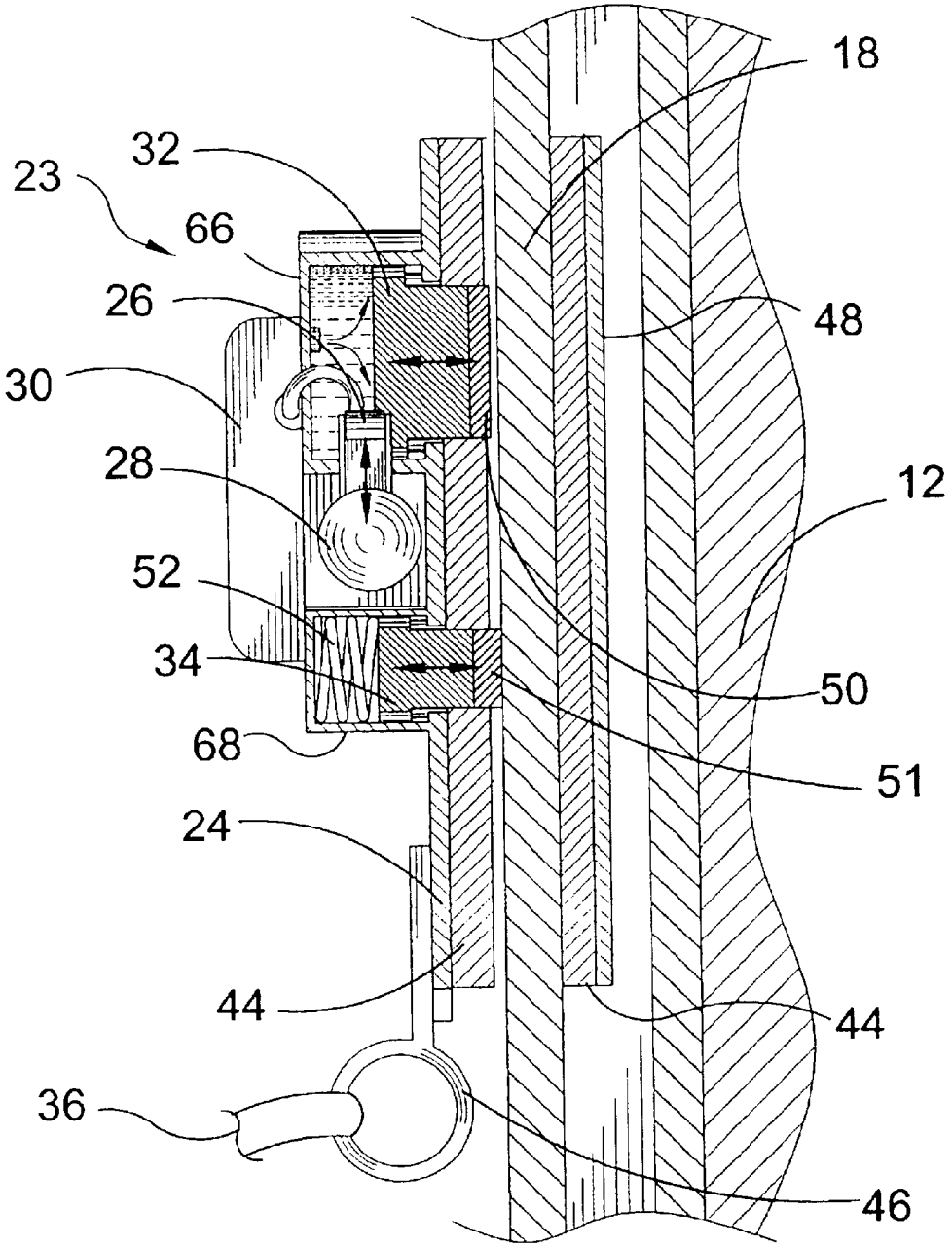
FIG. 8 is a sectional view of the descent assembly attached to a descent track.

Turning to FIG. 8, shown therein is a partial sectional view of the descent assembly 23 attached to a descent track 18 attached to the exterior wall of a tall building 12. Shown is the manner whereby the descent assembly 23 and its housing 24 of the present invention engages the descent track 18 when reduced descent speed is desired. The user slows their descent speed by manipulating the brake control 26 that causes the master cylinder 30 to pump increased amounts of brake fluid into the upper piston 32 and cylindrical housing 66 causing increased pressure between the brake pad 50 and the descent track 18 of the present invention producing an increased frictional coefficient that effectively slows the user's descent. Also shown are brake pads 51, handle 28, coil spring 52 for the preselected brake control, lower piston 34 and cylindrical housing 68, frictionous material 44, flange 48, attachment member 46 and harness cable 36.

Figure 9:
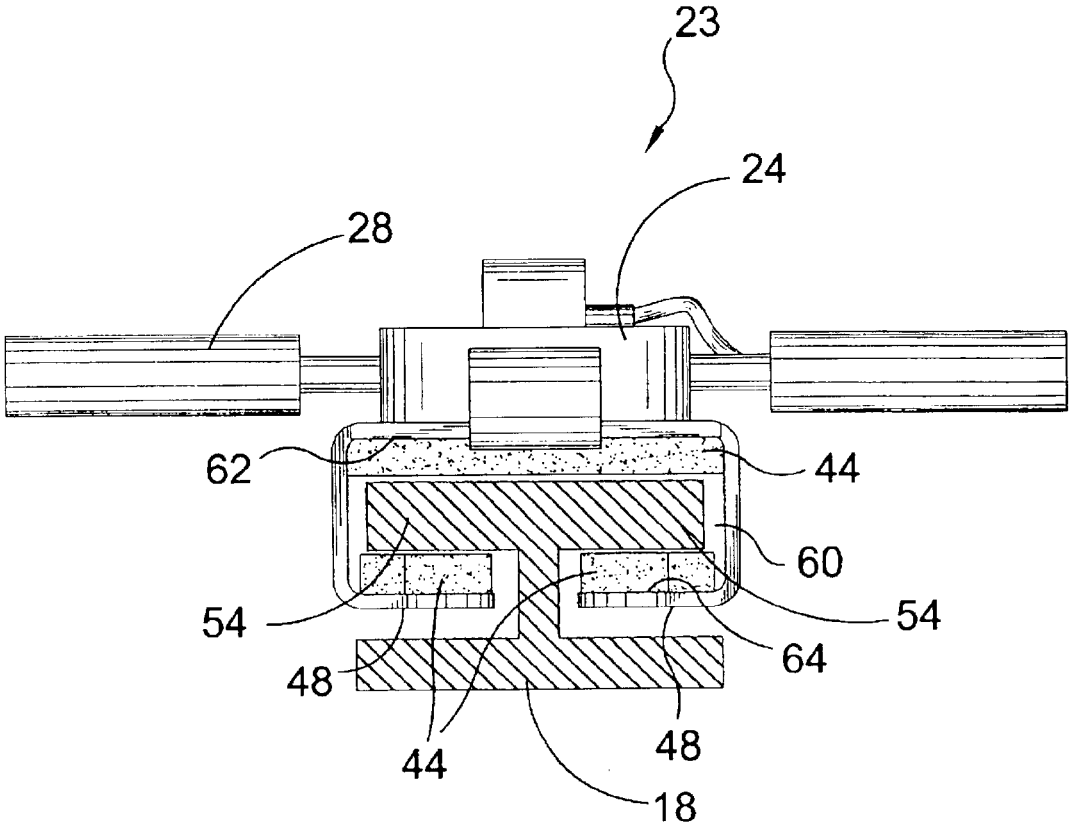
FIG. 9 is end view of the descent assembly attached to a descent track.

Turning to FIG. 9, shown therein is a lower end view of the descent assembly 23 and its housing 24 attached to a descent track 18. Shown is the descent assembly 23 having a semi-interior cavity 60 therein for receiving the I-beam descent track 18 therein, wherein the descent device 23 has frictionous material 44 positioned on the underside of the descent track 18 and brake pads and frictionous material 44 engaging the outer side face or connection bar 54 of the descent track 18. The frictionous material 44 pad engaging the face 54 of the track 18 serve as a drag brake that slows the descent of the user depending on the preselected tension brake that is sized to the suit size which is related to the weight of the descending user. The second brake is hydraulic and is under the control of the descending user. Handle 28 is also shown. The semi-interior cavity 60 is referred to as a "semi" because there is an open space between the two flanges 48. The frictionous material 44 is disposed inside the semi-interior cavity 60 and is attached to the interior surface of the top side of the descent assembly housing 23 at 62 and the interior surface of the flanges 48 at 64.

Figure 10:
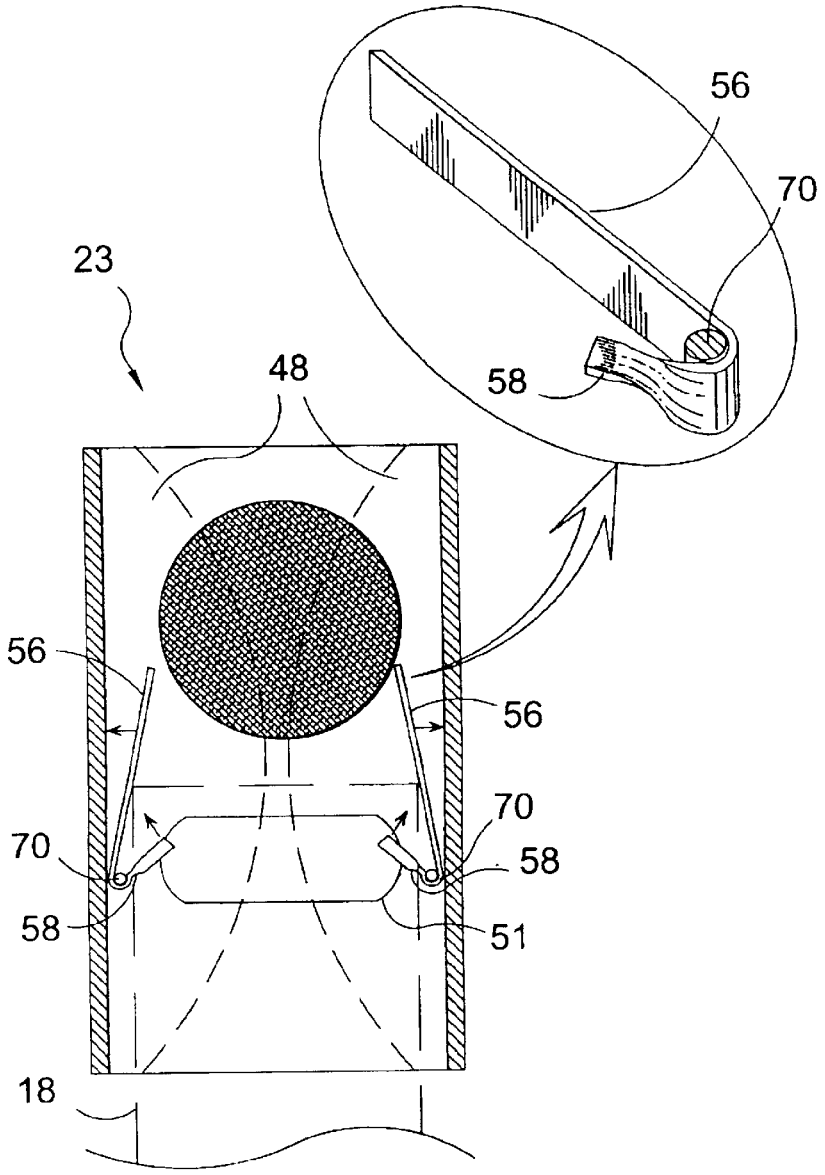
FIG. 10 is a bottom view of the brake release of the present invention.

Turning to FIG. 10, shown therein is a bottom view of the drag brake release mechanism. Shown is a bottom view of the descent device 23 with the flanges 48 shown in outline. The drag brake has a preselected tensioning coil 52 designed to force the brake pad 51 to engage the descent track face 54 with a pressure determined by the suit size which has a correlation to the weight of the individual wearing the suit. The drag brake release mechanism has a lever 56, pivotable connection 70, and a tab 58 that is positioned over the drag brake pad 51 whereby the descent mechanism 23 can be mounted to the end of the track 18 without the end of brake pad 51 contacting the top end of the track 18 and whereby the top end of the track 18 will automatically engage the drag brake release lever 56 moving the tabs 58 off of the drag brake pad 51. Once disengaged, the drag brake pad 51 will be free to move or be urged by tension spring 52 into engagement with the descent track face 54. The tab 58 thickness is less than the distance moved by the drag brake pad 51 to engage the track 18; therefore, the tab 58 will not contact the descent track face 54 or otherwise interfere with the workings of the descent mechanism.

I claim:

1. An apparatus for an emergency descent device for use by an individual and for attachment onto the exterior wall of a multiple story building, comprising:

a) a wall of a building wherein said wall is an exterior wall of a multiple story building, said building having a top and a bottom;

b) a descent track disposed on said wall of said building wherein said track extends from said top to said bottom of said building, said descent track having a first end oriented toward said top of said building said descent track further has the shape of an I-beam, said descent track I-beam have an inner portion, and an outer face portion, said outer face portion having a front side and a back side, wherein said inner portion is disposed adjacent said wall of the building;

c) a suit to be worn by an individual user, said suit being of a size suitable for said user;

d) a harness integral to said suit, said harness for safely securing an individual user therein;

e) an assembly means for a descent whereby an individual user can be safely attached to the descent track and can safety descend down the descent track;

f) a harness cable to permit said assembly means for descent to be securely attached to said harness of said suit, said harness cable having a first end for fixed attachment to said harness and a second end for fixed attachment to said assembly means for descent; and g) said descent assembly means comprises:

i) a descent assembly housing for attachment to said outer face portion of said descent track, said housing having a top end, a bottom end, a top side, a bottom side wherein said bottom side comprises a pair of inwardly extending flanges, and a pair of sides perpendicular to said top side and extending away from said top side toward said flanged bottom side wherein a semi-interior cavity is formed therein by said top side, said flanged bottom side and said pair of sides, said semi-interior cavity for receiving said outer face portion of said descent track therein, wherein said top side and said flanged bottom side each have an inner surface contiguous to said semi-interior cavity;

ii) an attachment member fixedly attached to said housing for receiving said second end of said harness cable to permit attachment of said descent assembly housing to said harness;

iii) frictionous material disposed on parts of said inner surface of said top side of said descent assembly housing and on said inner surface of said flanged bottom side to permit frictionous contact between the I-beam and the frictionous material so as to create a braking effect;

iv) a first brake disposed on said descent assembly housing whereby a preselected braking action is provided to said descent assembly housing in correlation to the size of said suit;

v) a second brake disposed on said descent assembly housing whereby a user is able to control the braking action provided to said descent assembly housing; and, vi) a handle to permit an individual to grasp onto the descent assembly housing.

2. The apparatus of claim 1, wherein said first brake comprises:

a) a lower piston disposed on said top side of said descent assembly housing, said piston having a first end and a second end;

b) a coiled spring for urging said lower piston toward a brake pad and said outer face portion of said descent track, said coiled spring contacting said first end of said lower piston;

c) a cylindrical housing disposed on said top side of said descent assembly housing for slidingly containing said lower piston and said coiled spring to permit the lower piston and coiled spring to slidingly operate therein;

d) a brake pad disposed on said second end of said lower piston, said brake pad passing through said top side of said descent assembly housing and said frictionous material to make contact with said outer face portion of said descent track; and, e) a brake release disposed on said brake pad whereby the brake pad is automatically released when the descent assembly housing is placed on the descent track.

3. The apparatus of claim 2, wherein said brake release comprises:

a) a brake release lever disposed adjacent said brake pad between said brake pad and said outer face portion of said descent track, said release lever having a first end and a second end;

b) a brake release tab disposed on said second end of said brake release lever, said tab disposed between said brake pad and said outer face portion of said descent track, said tab moving in response to movement of said brake release lever; and, c) a pivotable connection disposed on said brake release lever between said first end of said brake release lever and said brake release tab, said pivotable connection being attached to said inner surface of said top side of said descent assembly housing to permit the first end of the descent track to contact the brake release lever and thereby move the brake release tab to release the brake pad so it can contact the outer face of the descent track.

4. The apparatus of claim 3, wherein said first end of said brake release lever contacts said first end of said descent track to permit the release of the brake release tab and the brake pad.

5. The apparatus of claim 4, wherein said brake release tab has a thickness less than the distance necessary for said brake pad of the first preselected brake to move in order to contact said outer face of said descent track.

6. The apparatus of claim 5, wherein said second brake comprises:

a) a master cylinder containing hydraulic fluid disposed on said top side of said descent assembly housing to permit hydraulic pressure to be supplied to an upper hydraulic piston;

b) an upper hydraulic piston disposed on said top side of said descent assembly housing, said upper hydraulic piston having a first end and a second end;

c) a cylindrical housing disposed on said top side of said descent assembly housing, said sleeved housing for slidingly containing said upper hydraulic piston to permit the upper hydraulic piston to slidingly operate therein;

d) a brake pad disposed on said second end of said upper hydraulic piston, said brake pad passing through said top side of said descent assembly housing and said frictionous material to make contact with said outer face portion of said descent track; and, e) a brake cylinder control lever disposed on said top side of said descent assembly housing, said master cylinder operating in response to movement of said control lever, wherein hydraulic fluid moves said upper hydraulic piston and said brake pad in response to movement of said control lever to permit the second hydraulic brake to be controlled by the user.

7. The apparatus of claim 6, wherein said suit is sized for the user.

8. The apparatus of claim 7, wherein a suit may have a distinctive color to be associated with a physically challenged individual.

9. The apparatus of claim 8, wherein said lower piston and said brake pad of said first brake pass through said top side of said descent assembly housing and said frictionous material disposed thereon.

10. The apparatus of claim 9, wherein said upper hydraulic piston and said brake pad of said second brake pass through said top side of said descent assembly housing and said frictionous material disposed thereon.

11. The apparatus of claim 10 wherein said brake cylinder control lever is disposed adjacent said handle on said descent assembly housing to permit a user to easily grasp the brake cylinder control lever while holding onto the handle.

* * * * *